US010132595B2

(12) United States Patent
Moore

(10) Patent No.: US 10,132,595 B2
(45) Date of Patent: Nov. 20, 2018

(54) CROSS-BOW ALIGNMENT SIGHTER

(71) Applicant: Larry E. Moore, Cottonwood, AZ (US)

(72) Inventor: Larry E. Moore, Cottonwood, AZ (US)

( * ) Notice: Subject to any disclaimer, the term of this patent is extended or adjusted under 35 U.S.C. 154(b) by 106 days.

(21) Appl. No.: 15/075,769

(22) Filed: Mar. 21, 2016

(65) Prior Publication Data

US 2017/0003103 A1 Jan. 5, 2017

Related U.S. Application Data

(60) Provisional application No. 62/136,316, filed on Mar. 20, 2015.

(51) Int. Cl.

| | |
|---|---|
| ***F41G 1/467*** | (2006.01) |
| ***F41B 5/12*** | (2006.01) |
| ***F41G 1/54*** | (2006.01) |
| ***F41B 5/14*** | (2006.01) |

(52) U.S. Cl.

CPC ..... *F41G 1/545* (2013.01); *F41B 5/148* (2013.01); *F41G 1/467* (2013.01); *F41B 5/12* (2013.01)

(58) Field of Classification Search

CPC .. F41B 5/12; F41B 5/148; F41G 1/467; F41G 1/54; F41G 1/545

USPC ..... 33/265

See application file for complete search history.

(56) References Cited

U.S. PATENT DOCUMENTS

| | | | |
|---|---|---|---|
| 1,490,272 | A | 4/1924 | Hickam |
| 1,898,566 | A | 2/1933 | Noel |
| 2,268,056 | A | 12/1941 | Nelson et al. |
| 2,308,627 | A | 1/1943 | Rickenbacher |
| 2,357,951 | A | 9/1944 | Hale |
| 2,430,469 | A | 11/1947 | Karnes |
| 2,597,565 | A | 5/1952 | Chandler et al. |
| 2,701,930 | A | 2/1955 | Dolan |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Rudolf |
| 2,894,117 | A | 7/1959 | Koskey |
| 2,904,888 | A | 9/1959 | Niesp |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

Google Search for crossbow laser, image search conducted on Nov. 29, 2017, 14 pages.*

(Continued)

*Primary Examiner* — R. A. Smith

(74) *Attorney, Agent, or Firm* — Snell & Wilmer L.L.P.

(57) ABSTRACT

A crossbow sighter is used to align the sight used on a crossbow to the axis of the groove on the crossbow. In this manner, the cross bow bolt will strike close to, or at, the location sighted by the sight. The crossbow sighter fits into the groove and has a body with a length that extends past the bow string when the bow string is in its fully relaxed position. The bow string rests against the body and applies cross-axial pressure to the crossbow sighter and helps retain it in the groove while aligning the crossbow sight.

15 Claims, 6 Drawing Sheets

(56) References Cited

U.S. PATENT DOCUMENTS 2,926,916 A 3/1960 Pearson
3,104,478 A 9/1963 Strauss et al.
3,112,567 A 12/1963 Flanagan
3,192,915 A 7/1965 Norris et al.
3,284,905 A 11/1966 Simmons
3,510,965 A 5/1970 Rhea
3,526,972 A 9/1970 Sumpf
3,573,868 A 4/1971 Giannetti
3,618,673 A 11/1971 Gossett
3,633,285 A 1/1972 Sensney
3,641,676 A 2/1972 Knutsen et al.
3,645,635 A 2/1972 Steck
3,748,751 A 7/1973 Breglia et al.
3,801,205 A 4/1974 Eggenschwyler
3,813,795 A 6/1974 Marshall et al.
3,914,873 A 10/1975 Elliot, Jr. et al.
3,948,522 A 4/1976 Fixler
3,992,783 A 11/1976 Dunlap et al.
3,995,376 A 12/1976 Kimble et al.
4,026,054 A 5/1977 Snyder
4,048,489 A 9/1977 Giannetti
4,063,368 A 12/1977 McFarland et al.
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,346,530 A 8/1982 Stewart
4,348,828 A 9/1982 Snyder
4,352,665 A 10/1982 Kimble et al.
4,452,458 A 6/1984 Timander et al.
4,481,561 A 11/1984 Lanning
4,487,583 A 12/1984 Brucker
4,488,369 A 12/1984 Van Note
4,541,191 A 9/1985 Morris et al.
4,567,810 A 2/1986 Preston
4,662,845 A 5/1987 Gallagher et al.
4,713,889 A 12/1987 Santiago
4,763,431 A 8/1988 Allan et al.
4,825,258 A 4/1989 Whitson
4,830,617 A 5/1989 Hancox et al.
4,860,775 A 8/1989 Reeves et al.
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,004,423 A 4/1991 Bertrams
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,092,071 A 3/1992 Moore
5,119,576 A 6/1992 Erning
5,177,309 A 1/1993 Willoughby et al.
5,178,265 A 1/1993 Sepke
5,179,235 A 1/1993 Toole
5,194,007 A 3/1993 Marshall et al.
5,197,796 A 3/1993 Moore
5,208,826 A 5/1993 Kelly
5,179,124 A 6/1993 Schoenwald et al.
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,353,208 A 10/1994 Moore
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,509,226 A 4/1996 Houde-Walter
5,499,455 A 5/1996 Palmer
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,605,461 A 2/1997 Seeton
5,618,099 A 4/1997 Brubacher
5,621,999 A 4/1997 Moore
5,622,000 A 4/1997 Marlowe
5,654,594 A 8/1997 Bjornsen, III
5,669,174 A 9/1997 Teazel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,716,216 A 2/1998 O'Loughlin et al.
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,842,942 A * 12/1998 Doht et al. ..... F42B 6/02
473/578
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski

(56) References Cited

U.S. PATENT DOCUMENTS 6,282,829 B1 9/2001 Mossberg et al.
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,363,648 B1 4/2002 Kranich et al.
6,366,349 B1 4/2002 Houde-Walter
6,371,004 B1 4/2002 Peterson
6,378,237 B1 4/2002 Matthews et al.
6,385,893 B1 5/2002 Cheng
6,389,729 B2 5/2002 Rauch et al.
6,389,730 B1 5/2002 Millard
6,397,509 B1 6/2002 Langner
6,421,947 B1 * 7/2002 Fuller ..... F41G 1/545 42/116
6,430,861 B1 8/2002 Ayers et al.
6,434,874 B1 8/2002 Hines
6,442,880 B1 9/2002 Allan
6,345,464 B1 12/2002 Kim et al.
6,487,807 B1 12/2002 Kopman et al.
6,499,247 B1 12/2002 Peterson
6,526,688 B1 3/2003 Danielson et al.
6,568,118 B1 5/2003 Teetzel
6,571,503 B2 6/2003 Thorpe
6,572,375 B2 6/2003 Shechter et al.
6,575,753 B2 6/2003 Rosa et al.
6,578,311 B2 6/2003 Danielson et al.
6,579,098 B2 6/2003 Shechter
6,591,536 B2 7/2003 Houde-Walter et al.
6,606,797 B1 8/2003 Gandy
6,614,510 B1 9/2003 Rogers
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
6,682,350 B2 1/2004 Kehl
D487,791 S 3/2004 Freed
6,742,299 B2 6/2004 Strand
6,749,075 B2 6/2004 Bourque et al.
6,782,789 B2 8/2004 McNulty
6,804,907 B1 10/2004 Slobodkin
6,843,478 B1 1/2005 Hoepelman
6,854,205 B2 2/2005 Wikle et al.
6,860,053 B2 3/2005 Christiansen
6,931,775 B2 8/2005 Burnett
6,935,864 B2 8/2005 Shechter et al.
6,945,782 B2 9/2005 Isoz et al.
6,966,775 B1 11/2005 Kendir et al.
7,032,342 B2 4/2006 Pikielny
7,049,575 B2 5/2006 Hotelling
7,111,424 B1 9/2006 Moody et al.
7,117,624 B2 10/2006 Kim
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,325,352 B2 2/2008 Matthews et al.
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
7,387,052 B2 6/2008 Chang et al.
RE40,429 E 7/2008 Oliver et al.
7,409,770 B2 * 8/2008 Jones ..... F41G 1/35 124/87
D578,599 S 10/2008 Cheng
7,438,430 B2 10/2008 Kim
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,505,119 B2 3/2009 Rogers
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 11/2010 Stokes
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,001,715 B2 8/2011 Stokes
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,100,694 B2 1/2012 Portoghese et al.
8,104,220 B2 1/2012 Cobb
D653,798 S 2/2012 Janice et al.
8,109,024 B2 2/2012 Abst
8,110,760 B2 2/2012 Sharrah et al.
8,127,485 B2 3/2012 Moore
8,132,352 B2 3/2012 Lippard
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,147,304 B2 4/2012 Yamada
8,151,504 B1 4/2012 Aiston
8,151,505 B2 4/2012 Thompson
8,166,694 B2 5/2012 Swan
8,172,139 B1 5/2012 McDonald et al.
8,182,109 B2 5/2012 Matthews et al.
D661,366 S 6/2012 Zusman
8,196,328 B2 6/2012 Simpkins
8,215,047 B2 7/2012 Ash et al.

(56) References Cited

U.S. PATENT DOCUMENTS 8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,543 B2 1/2013 Rosol et al.
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 6/2013 McRae
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S 1/2014 Bietsch
8,646,201 B2 2/2014 Hughes
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S 7/2014 Klecker et al.
D710,966 S 8/2014 Barfoot et al.
8,807,779 B1 8/2014 Izumi et al.
8,813,411 B2 8/2014 Moore et al.
8,844,189 B2 9/2014 Moore et al.
D720,423 S 12/2014 Barfoot et al.
8,915,009 B2 12/2014 Caulk
8,919,023 B2 12/2014 Merritt et al.
8,927,083 B2 1/2015 Pell
8,938,904 B1 1/2015 Sellers et al.
D722,125 S 2/2015 Zayatz et al.
8,944,626 B2 2/2015 Matthews et al.
8,944,838 B2 2/2015 Mulfinger
8,991,093 B1 3/2015 Calvert
9,011,279 B2 4/2015 Johnson et al.
9,023,459 B2 5/2015 Hogue
9,146,077 B2 9/2015 Moore
9,182,194 B2 11/2015 Moore
9,188,407 B2 11/2015 Moore
9,243,865 B1 1/2016 Bruhns
9,272,402 B2 3/2016 Hu
9,297,614 B2 3/2016 Moore
9,453,702 B2 9/2016 Bruhns
9,644,826 B2 5/2017 Moore
9,658,031 B1 5/2017 Hedeen
9,772,163 B2 9/2017 Sharrah et al.
9,777,984 B1 10/2017 Bonine
9,791,240 B2 10/2017 Bruhns
D802,704 S 11/2017 Planck
9,810,411 B2 11/2017 Galli
9,829,280 B1 11/2017 Moore et al.
9,841,254 B2 12/2017 Moore
9,915,508 B2 3/2018 Moore et al.
9,982,963 B2 5/2018 Johnson
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0104249 A1 8/2002 Lin
2002/0129536 A1 9/2002 Iafrate et al.
2002/0134000 A1 9/2002 Varshneya et al.
2002/0148153 A1 10/2002 Thorpe
2002/0194767 A1 12/2002 Houde Walter et al.
2003/0003424 A1 1/2003 Shechter et al.
2003/0029072 A1 3/2003 Danielson
2003/0084601 A1 5/2003 Kunimoto
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen
2004/0064994 A1 4/2004 Luke
2005/0044736 A1 3/2005 Liao
2005/0130739 A1 6/2005 Argentar
2005/0153262 A1 7/2005 Kendir
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny
2006/0162225 A1 7/2006 Danielson
2006/0191183 A1 8/2006 Griffin
2007/0039226 A1 2/2007 Stokes
2007/0041418 A1 2/2007 Laughman
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones et al.
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0227298 A1 9/2010 Charles
2010/0229448 A1 9/2010 Houde-Walter
2010/0263254 A1 10/2010 Glock
2010/0275496 A1 11/2010 Solinsky et al.
2011/0047850 A1 3/2011 Rievley et al.
2011/0061283 A1 3/2011 Cavallo
2011/0074303 A1 3/2011 Stokes
2011/0119868 A1 5/2011 LaLonde
2011/0154712 A1 6/2011 Moore

(56) References Cited

U.S. PATENT DOCUMENTS

| | | | | |
|---|---|---|---|---|
| 2011/0162249 | A1 | 7/2011 | Woodmansee et al. | |
| 2011/0162251 | A1 | 7/2011 | Houde-Walter | |
| 2011/0185619 | A1 | 8/2011 | Finnegan et al. | |
| 2011/0225867 | A1 | 9/2011 | Moore | |
| 2012/0005938 | A1 | 1/2012 | Sloan | |
| 2012/0047787 | A1 | 3/2012 | Curry | |
| 2012/0055061 | A1 | 3/2012 | Hartley et al. | |
| 2012/0110886 | A1 | 5/2012 | Moore et al. | |
| 2012/0124885 | A1 | 5/2012 | Caulk et al. | |
| 2012/0129136 | A1 | 5/2012 | Dvorak | |
| 2012/0144716 | A1 | 6/2012 | Cabahug et al. | |
| 2012/0144718 | A1 | 6/2012 | Danielson | |
| 2012/0180366 | A1 | 7/2012 | Jaroh et al. | |
| 2012/0180367 | A1 | 7/2012 | Singh | |
| 2012/0180370 | A1 | 7/2012 | McKinley | |
| 2012/0224357 | A1 | 9/2012 | Moore | |
| 2012/0268920 | A1 | 10/2012 | Matthews | |
| 2013/0185978 | A1 | 7/2013 | Dodd et al. | |
| 2013/0185982 | A1 | 7/2013 | Hilbourne et al. | |
| 2013/0205635 | A1 | 8/2013 | Hines et al. | |
| 2013/0263492 | A1 | 10/2013 | Erdle | |
| 2013/0318851 | A1 | 12/2013 | Diamond et al. | |
| 2014/0007485 | A1 | 1/2014 | Castejon | |
| 2014/0109457 | A1 | 4/2014 | Speroni | |
| 2014/0157645 | A1 | 6/2014 | Moore | |
| 2014/0176463 | A1* | 6/2014 | Donahoe | F41B 5/1403 345/173 |
| 2014/0256481 | A1* | 9/2014 | Flint | F42B 6/04 473/578 |
| 2014/0355258 | A1 | 12/2014 | Izumi et al. | |
| 2015/0192391 | A1 | 7/2015 | Moore | |
| 2015/0226508 | A1 | 8/2015 | Hughes | |
| 2015/0233668 | A1 | 8/2015 | Moore | |
| 2015/0283459 | A1 | 10/2015 | Condon et al. | |
| 2015/0308670 | A1 | 10/2015 | Moore | |
| 2015/0345905 | A1 | 12/2015 | Hancosky | |
| 2015/0348330 | A1 | 12/2015 | Balachandreswaran et al. | |
| 2016/0059136 | A1 | 3/2016 | Ferris | |
| 2016/0084618 | A1 | 3/2016 | Hong | |
| 2016/0091285 | A1 | 3/2016 | Mason | |
| 2016/0161220 | A1 | 6/2016 | Moore et al. | |
| 2016/0169608 | A1 | 6/2016 | Schulz | |
| 2016/0195366 | A1 | 7/2016 | Kowalczyk et al. | |
| 2016/0209170 | A1 | 7/2016 | Mock et al. | |
| 2016/0209174 | A1 | 7/2016 | Hartley et al. | |
| 2016/0245617 | A1 | 8/2016 | Moore | |
| 2016/0305748 | A1 | 10/2016 | Moore et al. | |
| 2016/0361626 | A1 | 12/2016 | Moore | |
| 2017/0030677 | A1 | 2/2017 | Faifer | |
| 2017/0082399 | A1 | 3/2017 | Moore et al. | |
| 2017/0153095 | A1 | 6/2017 | Moore | |
| 2017/0160054 | A1 | 6/2017 | Moore | |
| 2017/0205182 | A1 | 7/2017 | Hughes et al. | |
| 2018/0023923 | A1 | 1/2018 | Uhr | |
| 2018/0058804 | A1 | 3/2018 | Moore | |
| 2018/0135944 | A1 | 5/2018 | Moore | |
| 2018/0149443 | A1 | 5/2018 | Dottle | |

OTHER PUBLICATIONS

Google Search for crossbow laser, text search conducted on Nov. 29, 2017, 2 pages.*

CrossbowNation—Community—Gear Review, Crossbow Laser Boresighter Bolt video review, dated Apr. 18, 2010, 1 page, printed on Nov. 29, 2017.*

CrossbowNation, Gear Review, Crossbow Laser Boresighter Bolt video review, dated Apr. 18, 2010, 6 images taken therefrom, 6 pages, printed on Nov. 29, 2017.*

EPO; Office Action dated Oct. 5, 2011 in Serial No. 09169459.

EPO; Office Action dated Oct. 5, 2011 in Serial No. 09169469.

EPO; Office Action dated Dec. 20, 2011 in Application No. 09169476.

EPO; Office Action dated Sep. 3, 2012 in Application No. 09169469.

EPO; Office Action dated Sep. 3, 2012 in Application No. 09169476.

EPO; Office Action dated Sep. 3, 2012 in Application No. 09169459.

EPO; Search Opinion and Report dated Aug. 6, 2010 in Serial No. 09169459.

EPO; Search Opinion and Report dated Aug. 6, 2010 in Serial No. 0969469.

EPO; Search Opinion and Report dated Aug. 23, 2010 in Serial No. 09169476.

EPO; Search Report and Opinion dated Aug. 6, 2012 in Serial No. 11151504.

USPTO; Advisory Action dated Aug. 22, 2011 in U.S. Appl. No. 12/249,781.

USPTO; Advisory Action dated Jul. 13, 2012 in U.S. Appl. No. 12/249,781.

USPTO; Final Office Action dated Feb. 24, 2010 in U.S. Appl. No. 11/317,647.

USPTO; Final Office Action dated Mar. 6, 2012 in U.S. Appl. No. 12/610,213.

USPTO; Final Office Action dated May 2, 2012 in U.S. Appl. No. 12/249,781.

USPTO; Final Office Action dated Jun. 29, 2009 in U.S. Appl. No. 11/317,647.

USPTO; Final Office Action dated May 18, 2011 in U.S. Appl. No. 12/249,781.

USPTO; Final Office Action dated Aug. 7, 2012 in U.S. Appl. No. 12/249,781.

USPTO; Notice of Allowance dated Feb. 2, 2011 in U.S. Appl. No. 12/249,794.

USPTO; Notice of Allowance dated Feb. 26, 2002 in U.S. Appl. No. 09/624,124.

USPTO; Notice of Allowance dated Mar. 3, 2011 in U.S. Appl. No. 12/249,785.

USPTO; Notice of Allowance dated May 13, 2011 in U.S. Appl. No. 12/249,785.

USPTO; Notice of Allowance dated May 17, 2011 in U.S. Appl. No. 13/077,861.

USPTO; Notice of Allowance dated Jul. 8, 2011 in U.S. Appl. No. 12/249,794.

USPTO; Notice of Allowance dated Sep. 1, 2011 in U.S. Appl. No. 13/077,861.

USPTO; Notice of Allowance dated Nov. 1, 2011 in U.S. Appl. No. 13/077,875.

USPTO; Notice of Allowance dated Nov. 18, 2011 in U.S. Appl. No. 13/077,861.

USPTO; Notice of Allowance dated Jul. 25, 2012 in U.S. Appl. No. 12/610,213.

USPTO; Notice of Allowance dated Aug. 16, 2012 in U.S. Appl. No. 13/346,621.

USPTO; Office Action dated Jan. 26, 2012 in U.S. Appl. No. 12/249.781.

USPTO; Office Action dated Sep. 28, 2009 in U.S. Appl. No. 11/317,647.

USPTO; Office Action dated Oct. 6, 2010 in U.S. Appl. No. 12/249,794.

USPTO; Office Action dated Oct. 18, 2011 in U.S. Appl. No. 12/610,213.

USPTO; Office Action dated Nov. 8, 2010 in U.S. Appl. No. 12/249,781.

USPTO; Office Action dated Dec. 26, 2008 in U.S. Appl. No. 11/317,647.

USPTO; Office Action dated Jun. 11, 2001 in U.S. Appl. No. 09/624,124.

USPTO; Office Action dated Jun. 22, 2011 in U.S. Appl. No. 13/077,875.

USPTO; Office Action dated Nov. 15, 2012 in U.S. Appl. No. 13/412,385.

USPTO; Office Action dated Feb. 1, 2013 in U.S. Appl. No. 12/249,781.

USPTO; Office Action dated Feb. 20, 2013 in U.S. Appl. No. 13/670,278.

USPTO; Office Action dated Mar. 26, 2013 in U.S. Appl. No. 13/353,241.

USPTO; Final Office Action dated Sep. 24, 2013 in U.S. Appl. No. 13/353,241.

(56) References Cited

OTHER PUBLICATIONS

USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,365.
USPTO; Office Action dated Nov. 20, 2014 in U.S. Appl. No. 13/353,165.
USPTO; Notice of Allowance dated Jun. 5, 2015 in U.S. Appl. No. 13/353,165.
USPTO; Notice of Allowance dated Jul. 24, 2015 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014 in U.S. Appl. No. 13/707,312.
USPTO; Notice of Allowance dated Jun. 11, 2014 in U.S. Appl. No. 13/707,312.
USPTO; Notice of Allowance dated Jul. 7, 2015 in U.S. Appl. No. 14/182,140.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Notice of Allowance dated Jun. 24, 2015 in U.S. Appl. No. 14/316,688.
USPTO; Office Action dated Mar. 3, 2015 in U.S. Appl. No. 14/278,315.
USPTO; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Nov. 24, 2015 in U.S. Appl. No. 14/459,274.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.
USPTO; Non-Final Office Action dated Aug. 30, 2016 in U.S. Appl. No. 14/955,440.
UPSTO; Non-Final Office Action dated Oct. 6, 2016 in U.S. Appl. No. 15/243,813.
USPTO; Notice of Allowance dated Apr. 26, 2017 in U.S. Appl. No. 15/130,744.
USPTO; Final Office Action dated May 18, 2017 in U.S. Appl. No. 15/243,813.
USPTO; Non-Final Office Action dated Jun. 2, 2017 in U.S. Appl. No. 14/963,475.
USPTO; Requirement for Restriction dated Jun. 5, 2017 in U.S. Appl. No. 14/863,304.
USPTO; Office Action dated Feb. 24, 2017 in U.S. Appl. No. 15/166,145.
USPTO; Notice of Allowance dated Mar. 7, 2017 in U.S. Appl. No. 14/630,467.
USPTO; Supplemental Notice of Allowance dated Sep. 13, 2017 in U.S. Appl. No. 15/166,145.
USPTO; Final Office Action dated Sep. 28, 2017 in U.S. Appl. No. 15/243,813.
USPTO; Notice of Allowance dated Oct. 27, 2017 in U.S. Appl. No. 14/955,440.
USPTO; Notice of Allowance dated Nov. 13, 2017 in U.S. Appl. No. 14/955,440.
UPSTO; Notice of Allowance and Fees Due dated Jul. 11, 2017 in U.S. Appl. No. 15/130,744.
USPTO; Notice of Allowance and Fees Due dated Jul. 31, 2017 in U.S. Appl. No. 15/166,145.
USPTO; Non-Final Office Action dated Aug. 24, 2017 in U.S. Appl. No. 15/253,543.
USPTO; Notice of Allowance dated Nov. 15, 2016 in U.S. Appl. No. 14/630,467.
USPTO; Non-Final Office Action dated Dec. 18, 2017 in U.S. Appl. No. 15/787,134.
USPTO; Final Office Action dated Jan. 16, 2018 in U.S. Appl. No. 14/963,475.
USPTO; Final Office Action dated Feb. 7, 2018 in U.S. Appl. No. 15/253,543.
USPTO; Non-Final Office Action dated Feb. 8, 2018 in U.S. Appl. No. 14/863,304.
USPTO; Non-Final Office Action dated Feb. 26, 2018 in U.S. Appl. No. 15/804,229.
USPTO; Advisory Action dated May 15, 2018 in U.S. Appl. No. 14/963,475.
USPTO; Requirement for Restriction dated Jun. 11, 2018 in U.S. Appl. No. 15/181,279.
USPTO; Advisory Action dated Jun. 14, 2018 in U.S. Appl. No. 15/253,543.
USPTO; Notice of Allowance dated Jun. 20, 2018 in U.S. Appl. No. 15/787,134.
USPTO; Non-Final Office Action dated Jun. 29, 2018 in U.S. Appl. No. 15/600,571.
USPTO; Non-Final Office Action dated Jul. 3, 2018 in U.S. Appl. No. 14/963,475.
USPTO; Non-Final Office Action dated Jul. 20, 2018 in U.S. Appl. No. 15/253,543.
Ducet, "Arsenal Strike One Review," http://dennyducet.blogspot.com/2015/06/the-arsenal-strike-one-innovative.html, (Jun. 18, 2015).

* cited by examiner

CROSS-BOW ALIGNMENT SIGHTER

CROSS REFERENCE TO RELATED APPLICATIONS

This application claims priority to U.S. Provisional Application No. 62/136,316, filed on Mar. 20, 2015. U.S. Pat. No. 6,421,947 is incorporated herein by reference to the extent its disclosure is not inconsistent with the present disclosure.

FIELD OF THE INVENTION

The present invention relates to a sighter for aligning the sight on a crossbow to at least approximately the location where the crossbow bolt strikes after being fired.

BACKGROUND OF THE INVENTION

This invention relates to a sighter for calibrating a crossbow sight to align with the groove axis of a crossbow for the purpose of calibrating the crossbow sight. The calibration process of a crossbow scope to align the sight with the crossbow groove axis now requires that several bolts be fired so that the sight can be gradually adjusted to align with a target point that the bolts strike. The crossbow sight can be a physical sight or an optical scope. Crossbow sights and crossbow structures are known to those skilled in the art.

SUMMARY OF THE INVENTION

A crossbow sighter for projecting an axis of a crossbow groove is used to align a crossbow's sight with the groove axis. The crossbow sighter (or "sighter") comprises a body that minimizes errors in alignment. The body is extended so it is long enough to be positioned in the crossbow groove and to have the bow string, when in its relaxed position, rest upon the body to help retain the sighter in the groove. The body has a proximal (or first) section, in which a laser is mounted, and that is received in the groove, and a distal (or second) section, which extends past the bow string, when the string is in its relaxed position. The bow string is positioned against the side of the second section to apply cross-axial force to the sighter and help retain it in the groove.

A sighter according to the invention may have a one-piece body, or a multi-piece body. Either way, it is designed to be axially aligned with the crossbow groove when positioned in the groove. In this manner, a beam of laser light emitted from the sighter travels in a straight path along the axis of the crossbow groove. The crossbow sight is then calibrated to the point at which the laser beam strikes.

DETAILED DESCRIPTION OF PREFERRED EMBODIMENTS

Figure 1:
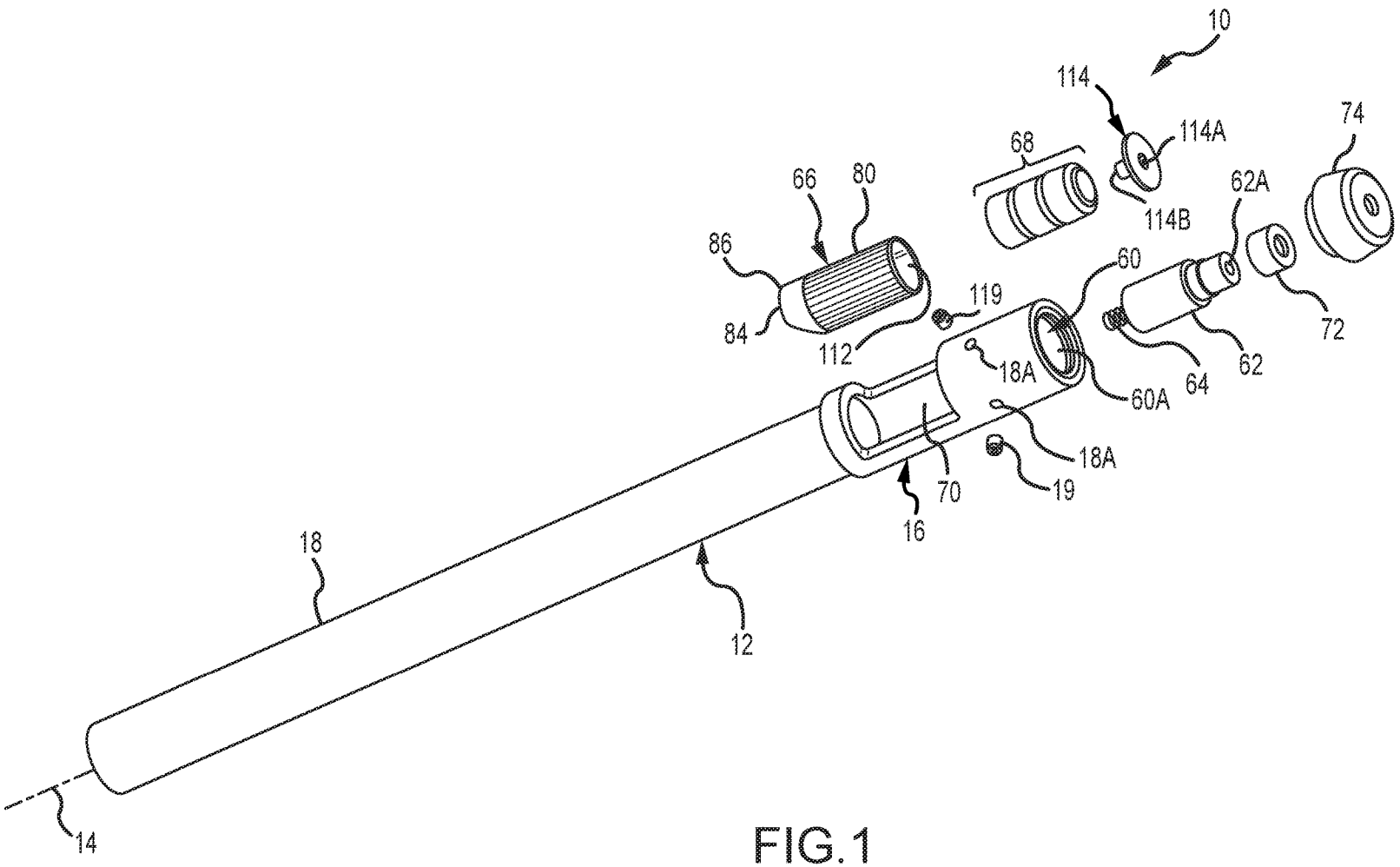
FIG. 1 is an exploded, perspective view of the crossbow sighter according to aspects of the invention.
Figure 2:
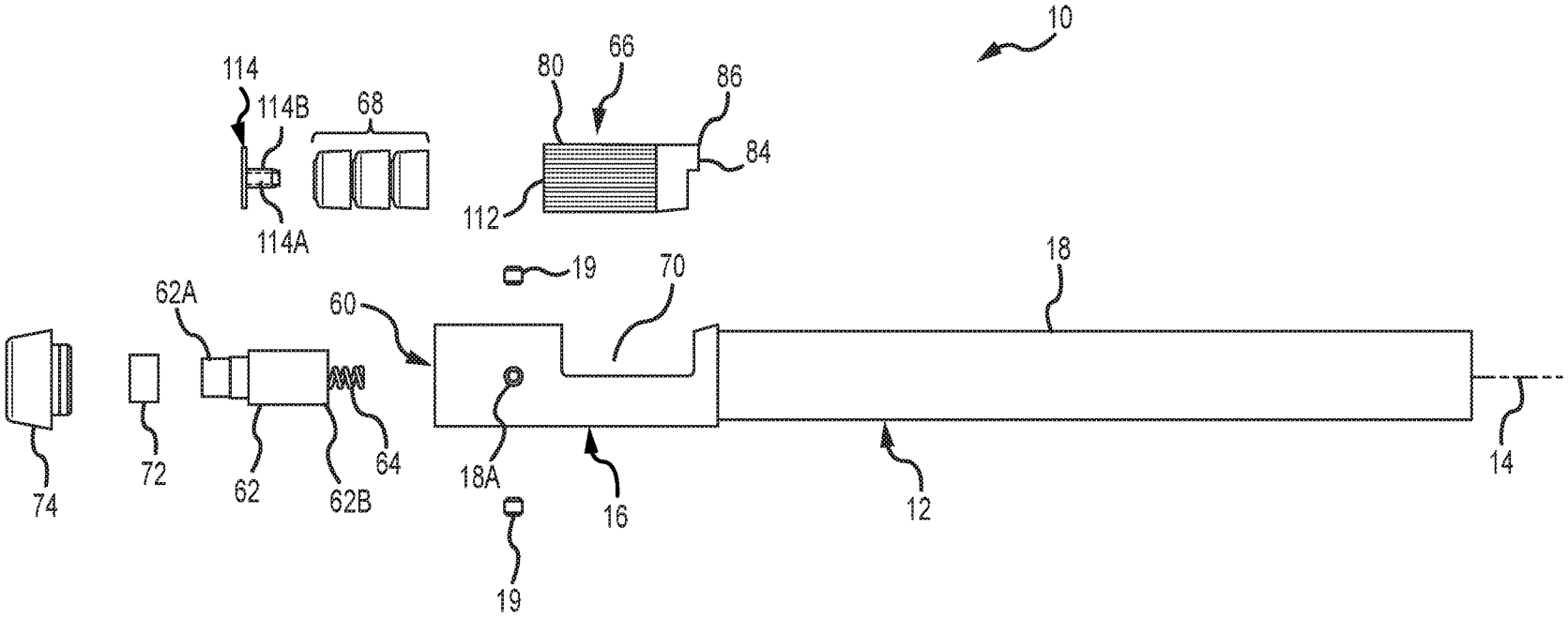
FIG. 2 is a side, exploded view of the crossbow sighter of FIG. 1.

Turning now to the drawings where the purpose is to describe preferred embodiments of the invention and not to limit same, FIGS. 1 and 2 show exploded views of a preferred embodiment of a crossbow sighter 10 according to the invention.

The crossbow sighter 10 comprises an elongated body 12 having a body axis 14. The body 12 has a proximal (or first) section 16 and a distal (or second) section 18. The proximal section 16 and distal section 18 may have the same diameter, or (as shown) the diameter of the proximal section 16 may be different from, and greater than, the diameter of the distal section 18.

Figure 5:
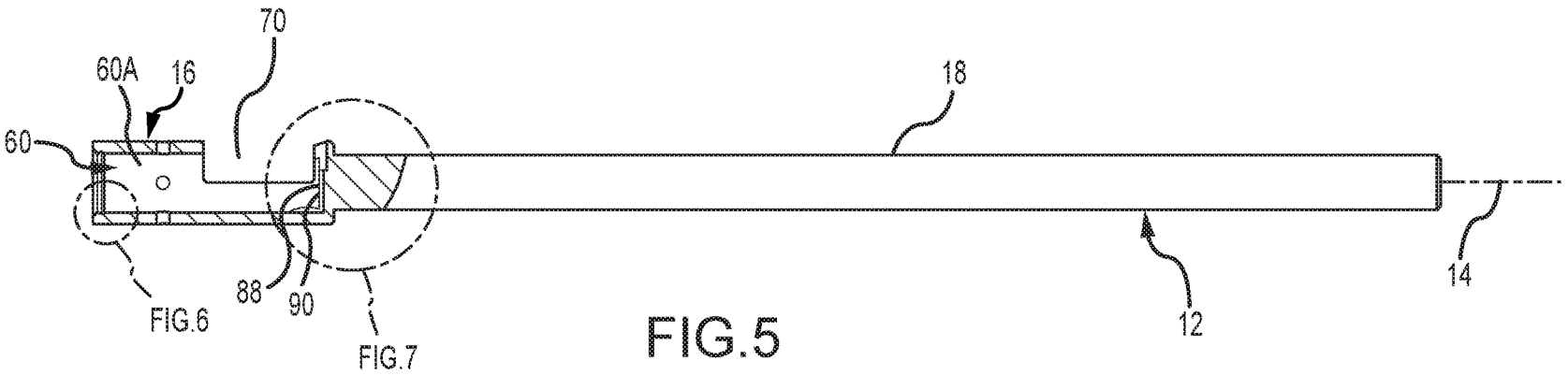
FIG. 5 is a side, partial cross-sectional view of the crossbow sighter of FIG. 4.
Figure 6:
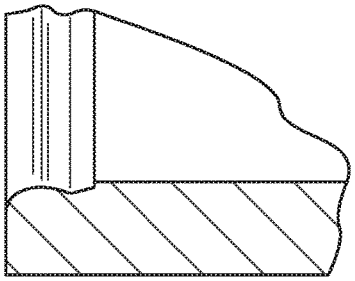
FIG. 6 is an enlarged view of the section marked as FIG. 6 on FIG. 5.
Figure 7:
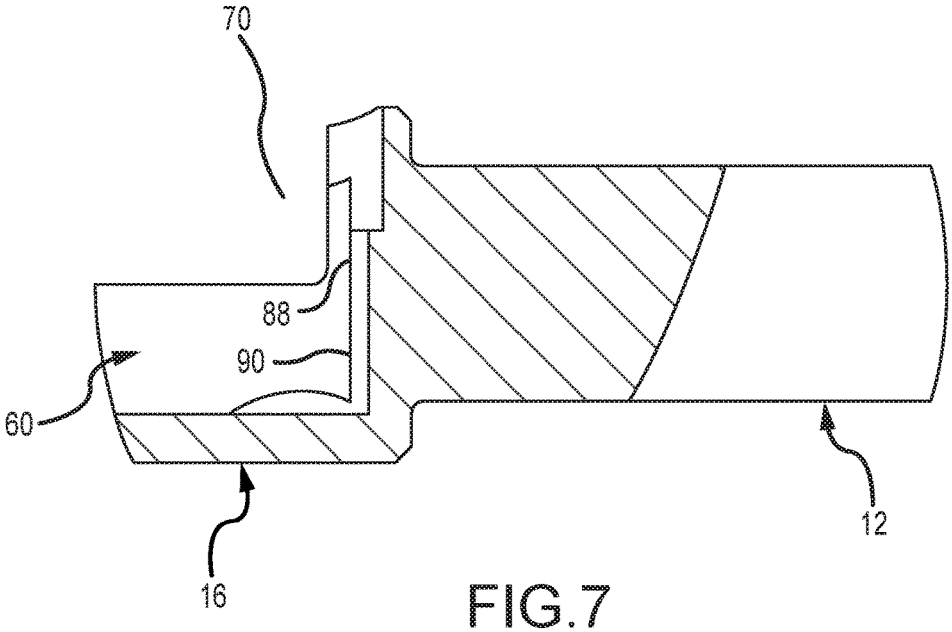
FIG. 7 is an enlarged view of the section marked as FIG. 7 on FIG. 5.
Figure 8:
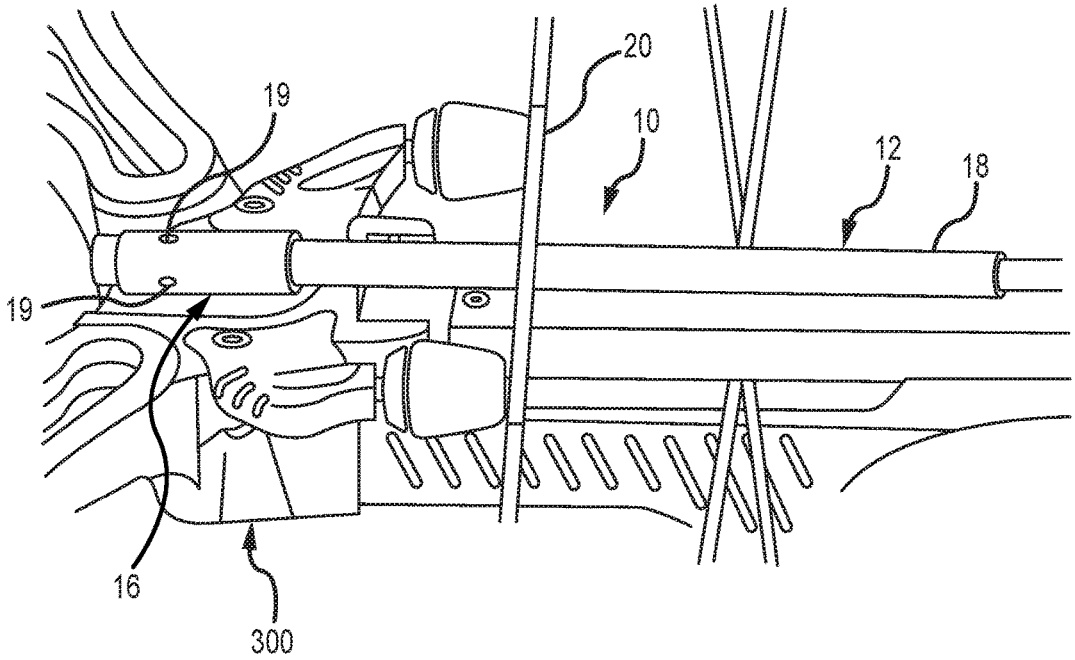
FIG. 8 is a side view of a crossbow sighter in accordance with aspects of the invention, mounted in a crossbow groove.

FIGS. 5-7 are partial cross-sectional illustrations of the crossbow sighter 10 of FIGS. 1 and 2, depicting the first cylindrical cavity. A first cavity 60 has an axis that is preferably aligned with body axis 14, and is located in the proximal end 16. The first cavity 60 houses a light source 62, typically a laser, an electrically conductive spring 64, and a rotary switch 66. The light source 62 is permanently mounted in the housing so that it need not be removed to change batteries or to make support adjustments. The light source 62 emits a beam that is in alignment with the body axis 14. The switch 66 is rotated to selectively connect the light source 62 to a power supply 68. The spring 64 keeps switch 66 locked into a position, either on or off, and provides an electrical path to the laser light 62. Proximal section 16 includes a channel 70 formed between the body surface and the first cavity 60 to expose the switch 66. The switch 66 can be accessed for rotation through channel 70.

Also shown in FIGS. 1 and 2, the body proximal section 16 includes a second cylindrical cavity 60A connected to channel 70. The second cavity 60A is preferably aligned with the body axis 14 to form an opening from which the light source beam is projected.

Figure 3A:
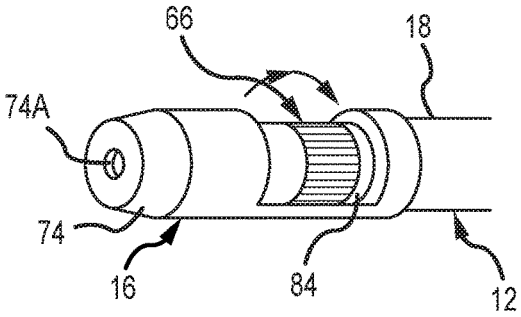
FIG. 3A is a partial, side perspective view of the crossbow sighter of FIG. 1 showing one alternative switch.
Figure 3B:
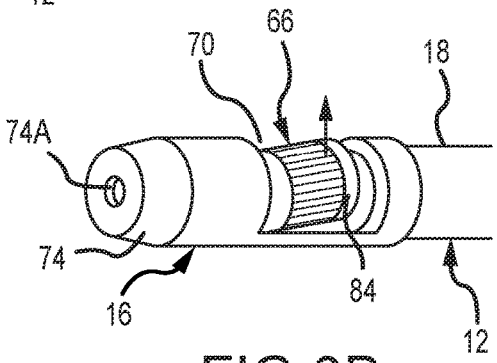
FIG. 3B is a partial, side perspective view of the crossbow sighter of FIG. 3 showing the beginning of removal of the switch assembly.

The first cavity 60 has a cavity diameter. The switch 66 is cylinder with a switch diameter that is less than the cavity diameter, so that switch 66 has the freedom to rotate (see e.g., FIG. 3A). The switch 66 has an axis preferably substantially aligned along the body axis 14. The switch 66 rotates to selectively connect the power source 68 to the light source 62.

The switch 66 has a top, or first outside surface 80 which is radially disposed around the switch axis. The first surface 80 has a conductive area 84. The first surface 80 also includes a cam 86.

Figure 4:
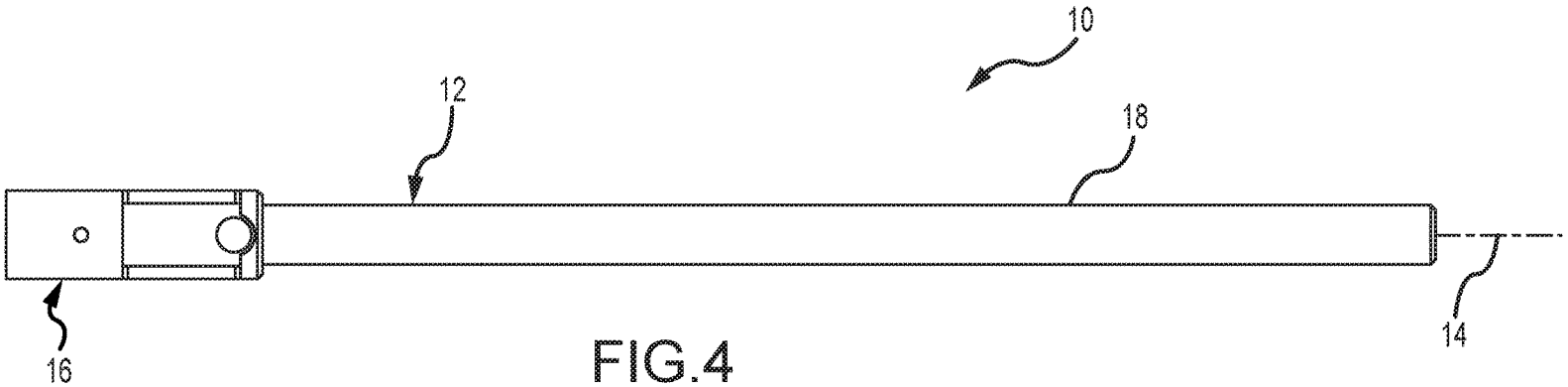
FIG. 4 is a top view of a crossbow sighter in accordance with aspects of the invention.

FIG. 5 is a partial cross-sectional view of the body 12 of FIG. 4. The first cavity 60 (see FIG. 5) has a second surface 88 which interfaces with the switch first surface 80, which is radially disposed inside proximal section 16. The second surface 88 includes a second conductive area. An electrical connection is made between the body 12 and the switch 66 when the second conductive area interfaces with the first conductive area 84. The second surface 88 is preferably cylindrical. When the second surface 88 receives the switch conductive area 84, an electrical connection is made between first conductive area 84 and second conductive area 90. The conductive areas are not limited to any special shape or position. As shown, the conductive areas can be centered around the axis 14. When the switch 66 is not in the channel 70, the first surface 80 and second surface 88 are forced apart, and no electrical connection is made.

Figure 3C:
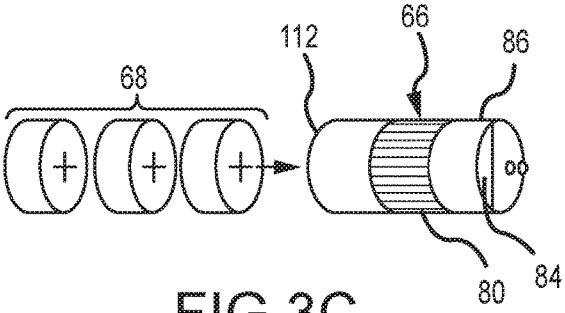
FIG. 3C is a side view of the removed switch assembly of the crossbow sighter of FIGS. 3A and 3B showing how batteries can be removed and replaced.
Figure 3D:
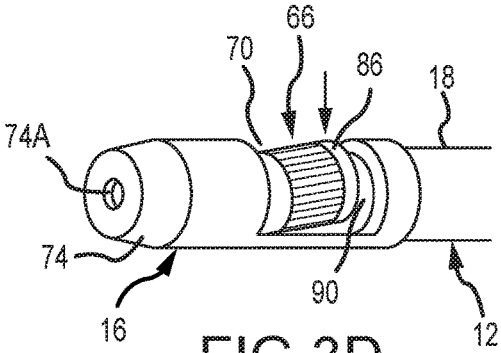
FIG. 3D is a partial, side perspective view of the crossbow sighter of FIGS. 3A-3C showing the switch assembly being reinstalled.

In some aspects of the invention the power supply 68 is housed elsewhere in the body 12 (not shown), but in the preferred embodiment power source 68 is housed in switch 66. In a preferred aspect of the invention the batteries are housed in the switch 66, as shown in FIGS. 1, 2 and 3C. Switch 66 is removable from cavity 60 through channel 70 as shown in Figures to replace batteries does not affect the accuracy of crossbow sighter 10. The switch 66 is easily removed through channel 70.

Power source 68 is preferably a number of (three are shown) coin batteries arranged end-to-end in a battery cavity 112. The power source 68 can also be any other suitable source. An axial plug 114, with a center hole 114 to admit spring 64, and a stem 114B, may be used to seal the end of battery cavity 112.

Turning again to FIGS. 1 and 2, a brace (or cushioning device) 72 fits over distal end 62A of laser 62. Laser light is emitted through end 62A. A cap 74 with a lens, which may be clear or refractory to refract the laser light into a shape such as a crosshair, or multiple projections forming an area between them, is received in cavity 60 to seal cavity 60 and the internal components. As shown, cap 74 is threadingly received in cavity 60.

Proximal section 16 has two openings 18A that receive fasteners 19, which are preferably thread screws. Fasteners 19 can be tightened against, or retracted from, laser 62 to move it up and down, or side to side.

FIG. 6 illustrates the crossbow sighter 10 mounted in a crossbow groove whose axis is projected by the laser light. The extended body 12 permits it to extend beyond the bow string 200, so the bow string 200 can be positioned on the side of the distal section 18, to press against the side of distal section 18 and help retain sighter 10 in the groove.

In a preferred embodiment, proximal section 16 has approximately the same diameter as a crossbow bolt and is received in the crossbow groove in the same manner as a bolt. Extended distal section 18, as shown, has a diameter slightly smaller than the diameter of proximal section 16. Body 12 can be one piece, or more than one piece, as long as it is sufficiently aligned along axis 14 so laser light emitted from laser 62 aligns with the axis 14 ad the axis of the crossbow groove. The length of body 12 is preferably 7", or at least 5", at least 6", or at least 7", or between 6½" and 7½". Body 12 preferably has a length that permits it to function with most, if not all, crossbows.

Some exemplary, specific examples of the invention are set forth below:

Example 1

A crossbow sighter for projecting a beam of light along the axis of a groove used to retain a crossbow bolt, the crossbow sighter comprising a body with a length greater than the distance between the groove and the crossbow string when the string is in a relaxed position, an outer surface dimensioned to be received in the groove, and a light source to emit a beam aligned with the groove axis.

Example 2

The crossbow sighter of example 1 wherein the body is cylindrical and has a uniform diameter.

Example 3

The crossbow sighter of example 1 wherein the diameter of the body varies.

Example 4

The crossbow sighter of example 3 wherein the light source is inside the body and there is an opening in an end of the body through which the light is emitted.

Example 5

The crossbow sighter of example 4 wherein the opening is covered by a lens.

Example 6

The crossbow sighter of any of examples 1-5 further comprising a power source connected to the light source.

Example 7

The crossbow sighter of example 6 further comprising a switch to selectively connect the power source to the light source.

Example 8

The crossbow sighter of example 7 wherein the body includes a first cavity to house the light source, the switch, and the power source.

Example 9

The crossbow sighter of example 8 wherein the body includes a second cavity connected to the first cavity to form an opening from which the light source beam is projected.

Example 10

The crossbow sighter of example 7 wherein the body includes a channel formed between the body surface and the first cavity to expose the switch.

Example 11

The crossbow sighter of example 10 wherein the switch is a partial cylinder, and wherein the switch is rotatable to selectively connect the power source to the light source.

Example 12

A The crossbow sighter of example 11 wherein the switch includes a first outside surface radially disposed around a switch axis and having a first conductive area and cam; wherein a first cavity of the body has a second surface radially disposed around the body axis, having a second conductive area and a channel to receive the switch cam; and wherein the switch cam cooperates with the second surface channel to selectively connect the first and second conductive areas.

Example 13

The crossbow sighter of example 12 wherein the switch has a third outside surface radially disposed around the switch axis, having a third conductive area, and wherein the first and third conductive areas are connected through the switch; wherein the first cavity has a fourth surface radially disposed around the body axis, having a fourth conductive area; and further comprising: an electrically conductive spring substantially aligned along the body axis between the third and fourth surfaces; and wherein the second and fourth conductive areas are selectively connected through the switch and spring.

Example 14

The crossbow sighter of example 13 wherein the body includes a conductive path, through the light sources, between the second and fourth conductive surfaces; wherein the switch includes a battery cavity; wherein the power source includes at least one battery, housed in the switch's battery cavity, having a first polarity connected to the switch's first conductive area and a second polarity connected to the switch's third conductive area; and wherein the light source is selectively powered with the battery.

Example 15

The crossbow sighter of example 1 wherein the light source is a laser.

Example 16

The crossbow sighter of any of examples 1-15 wherein the body is at least 5" long, or at least 6" long or at least 7" long.

Example 17

The crossbow sighter of any of examples 1-16 wherein the body is comprised of multiple sections.

Example 18

The crossbow sighter of any of examples 1-16 wherein the body is formed of a single section.

Example 19

The crossbow sighter of any of examples 1-18 wherein the body is comprised of aluminum, steel or plastic.

Having thus described some embodiments of the invention, other variations and embodiments that do not depart from the spirit of the invention will become apparent to those skilled in the art. The scope of the present invention is thus not limited to any particular embodiment, but is instead set forth in the appended examples and the legal equivalents thereof. Unless expressly stated in the written description or examples, the steps of any method recited in the examples may be performed in any order capable of yielding the desired result.

What is claimed:

1. A crossbow sighter for projecting a beam of light along the axis of a groove used to retain a crossbow bolt, the crossbow sighter comprising a body having a first end and a second end, with a length greater than the distance between the groove and the crossbow string when the crossbow string is in a relaxed position so that the first end is outside of the groove and past the relaxed crossbow string when the sighter is received in the groove, an outer surface dimensioned to be received in the groove, a power source at the first end, and a light source at the first end to emit a beam along the groove axis; and a switch positioned at the first end to selectively connect the power source to the light source.

2. The crossbow sighter of claim 1 wherein the body is cylindrical.

3. The crossbow sighter of claim 1 wherein the body diameter is uniform.

4. The crossbow sighter of claim 1 wherein the body includes a first cavity to house the light source, the switch, and the power source.

5. The crossbow sighter of claim 4 wherein the body includes an opening from which a beam of light from the light source is projected.

6. The crossbow sighter of claim 1 wherein the body includes a channel formed between the body surface and the first cavity to expose the switch.

7. The crossbow sighter of claim 6 wherein the switch is a partial cylinder, and wherein the switch is rotatable to selectively connect the power source to the light source.

8. The crossbow sighter of claim 7 wherein the switch includes a first outside surface radially disposed around a switch axis.

9. The crossbow sighter of claim 1 wherein the light source is a laser.

10. The crossbow sighter of claim 1 wherein the body is comprised of multiple sections.

11. The crossbow sighter of claim 1 wherein the body is formed of a single section.

12. The crossbow sighter of claim 1 wherein the body is comprised of one of the group consisting of: aluminum, steel or plastic.

13. The crossbow sighter of claim 1 wherein the body has a length of at least 5", or at least 6", or at least 7".

14. The crossbow sighter of claim 1 wherein the body has a length between 6" and 8".

15. The crossbow sighter of claim 1 wherein the body has a length of between 6½" and 7½".

* * * * *